US005765134A

United States Patent [19]

Kehoe

[11] Patent Number: 5,765,134

[45] Date of Patent: Jun. 9, 1998

[54] METHOD TO ELECTRONICALLY ALTER A SPEAKER'S EMOTIONAL STATE AND IMPROVE THE PERFORMANCE OF PUBLIC SPEAKING

[76] Inventor: Thomas David Kehoe, 18510 Decatur Dr., Monte Sereno, Calif. 95030-3088

[21] Appl. No.: 389,037

[22] Filed: Feb. 15, 1995

[51] Int. Cl.[6] ..... G10L 3/02

[52] U.S. Cl. ..... 704/270; 381/61

[58] Field of Search ..... 395/2.79, 2.8, 395/2.85, 2.87; 381/61; 704/270, 271, 276, 278

[56] References Cited

U.S. PATENT DOCUMENTS

| | | | |
|---|---|---|---|
| 4,377,158 | 3/1983 | Friedman et al. | 128/1 R |
| 4,632,126 | 12/1986 | Aguilar | 128/732 |
| 5,029,214 | 7/1991 | Hollander | 381/51 |
| 5,307,442 | 4/1994 | Abe et al. | 395/2.79 |

OTHER PUBLICATIONS

Elman, J.L.; "Effects of Frequency–Shifted Feedback on the Pitch of Vocal Productions;" Journal of Acoustical Society of America, vol. 70; pp. 45–50.

*Primary Examiner*—David D. Knepper

[57] ABSTRACT

The invention addresses the problem of undesirble emotional states in general, and during the performance of public speaking in particular. The user of the invention wears a microphone and earphones. The invention digitally alters how the user hears his or her voice, to sound as if the user is in a different emotional state. The user may choose preprogrammed emotional states such as confident authority or happy enthusiasm. The degree of the emotion may also be selected. The result is that the user's emotional state is altered when he or she speaks.

12 Claims, 4 Drawing Sheets

METHOD TO ELECTRONICALLY ALTER A SPEAKER'S EMOTIONAL STATE AND IMPROVE THE PERFORMANCE OF PUBLIC SPEAKING

BACKGROUND OF THE INVENTION

This invention relates, generally, to the field of personal communications, and more particularly, to speech-training devices and devices for improving the abilities of persons performing public speaking.

A speaker's mental state is apparent to listeners, from the aspects of the speaker's voice. These aspects include speaking rate, pitch, and repeated or unnecessary words.

Techniques for conveying a mental state through one's voice are well-developed among actors.

For example, an actor portraying a character with low status or low self-confidence will talk with a higher pitch, conveying tense speech-production muscles and general body tension.

A low-status character will move around, especially moving his hands and averting his eyes from the listener. This unnecessary movement is paralleled by speaking with unnecessary words or sounds. For example, the sentence, "I'm going to the store," becomes, "I'm, uh, going out, you know, I'm going to the, uh, store, the one just down the street, just going to the store."

The low-status character may also tend to repeat himself. This is because listeners tend to repeat back what they hear ("active listening") if they agree with the speaker. If the listener doesn't reflect back the speaker's words, the low-status character will suspect that the listener disagrees. The speaker then repeats himself in hopes that the listener just didn't hear it the first time, or will be convinced the second time around.

The fidgeting movements, unnecessary words, and repetitions result in a faster speaking rate.

An actor portraying a character with high status or high self-confidence will speak in a lower pitch, conveying relaxed speech-production muscles and general physical relaxation.

She will move slowly, with minimal movements. She will not add unnecessary words.

She will observe people, and convey a sense of peripheral vision. She will make eye contact with the listener. To convey observation through her voice, she pauses between sentences. For example, a school principal lecturing a disobedient student will pause to observe the student sweating and squirming.

The slowed movement, lack of unnecessary words, and pauses produce a slow speaking rate.

Smiling raises a speaker's vocal pitch, so a higher pitch can convey enthusiasm. An increased speaking rate can convey enthusiasm. An actor or radio personality may use a higher vocal pitch and increased speaking rate without conveying low-status if he avoids the other signs of low-status (such as unnecessary words).

An effective speaker will thus vary her vocal pitch and speaking rate. She may begin building a case by speaking slowly, with pauses, and a deeper pitch. When reaching her main point, however, she may increase her vocal pitch and her speaking rate to convey enthusiasm. Then she pause, to observe the reactions of her audience.

Many people experience anxiety while speaking in certain situations. The most common is fear of public speaking.

According to pollsters, public speaking is feared more than death. Some people fear speaking on telephones.

One reason that public speaking is challenging is the lack of active listeners. This is especially terrifying when speaking on radio or television. Many people are listening, but no one is expressing agreement with the speaker. Similarly, telephones do not allow the speaker to visually observe the reaction of the listener.

Another reason to fear public speaking is that the audience may be higher status than the speaker. For example, a manager may present his annual business plan to the board of directors. Similarly, individuals may fear telephoning higher status individuals, for example, a job applicant calling a potential employer. The job applicant may happily call his friends and chat for hours, but experiences elevated heart rate and sweaty palms when calling a potential employer.

People experience undesirable mental states when speaking. These undesirable mental states are then conveyed to listeners.

There is a large industry devoted to this problem. Toastmasters International, of Mission Viejo, Calif., has taught public speaking techniques to more than three million men and women. Public speaking courses are popular in community colleges. There are many for-profit public speaking seminars. There are also acting schools, and voice training courses for broadcasters.

In these courses, the student learns techniques to control her mental state, such as familiarizing herself with the room before the presentation, or pre-visualizing herself giving the presentation before she goes on-stage.

The student also learns the techniques described above, such as speaking slower, pausing, and making eye contact with audience members. She may be taught to not move around the stage, and not to let her hands fidget.

In other words, the student learns both to alter her mental state, and to convey an impression of a desirable mental state (i.e., act).

The reverse of an undesirable mental state causing an altered speaking voice also occurs. Altering one's way of speaking can alter one's mental state. For example, by speaking slower, making eye contact, etc., the speaker feels more confident and relaxed.

There would seem to be a simple technological solution to this problem. A electronic device known as a multiple effects processors can alter the pitch, and other parameters, of an audio signal. Many persons performing public speaking use public address systems. A multiple effects processor can easily plug into a P.A. system. The speaker then adjusts the pitch down a half-octave, and suddenly a 98-pound weakling has a voice as deep as Hercules!

Multiple effects processors are widely used in recording studios. For example, some radio stations broadcast their call letters read by a gravel-voiced man. The effect is done by a studio technician recording his or her voice, then turning the pitch control knob to the desired effect. The technician may then add reverb (a.k.a. an echo chamber) for resonance.

Some singers have their recorded voices processed through a chorus effect to sound fuller. This effect adds a short delay, and the pitch of the delay is modulated according to a preset pattern, usually a sine wave.

An effect similar to chorus, but with the delayed signal combined with and fed back into the first audio signal, and with a shorter delay is called flanging. Flanging produces metalic ringing, and is popular for electric guitar processing. It is rarely, if ever, used for vocal processing.

Such effects processing is never done by persons performing public speaking. Digital effects processing can't slow the speaking rate (in real-time) or remove the repeated words and extra sounds that characterize low-status speakers. Even with a deeper pitch and chorus or reverb, the speaker's poor mental state would be clear to the audience.

The speaker would hear his own voice sounding deeper and more confident, and this in turn would improve the speaker's mental state. However, the speaker would hear more than his altered voice. The speaker would hear his actual voice, his altered voice from the P.A. system, and echoes of the P.A. system, altered in time and pitch by the acoustics of the room. The result would confuse and distract the speaker, at a time when he least needs confusion.

There are other problems. What if the company directors hear the speaker sounding like James Earl Jones during the presentation, then invite the speaker out for lunch and discover that his voice actually sounds like Beaver Cleaver?

Singers similarly don't usually alter their voices for performances. A singer may have spent years developing a clear, effective voice, and building up an audience that recognizes that voice.

The only persons who enjoy electronically altering their voices in real-time for listeners are children. In recent years, a toy called the Voice Changer has become popular. This device looks like a plastic megaphone. The child speaks into a microphone on one end, and his voice comes out a speaker on the other end sounding like an alien, a robot, or a ghost.

There is one other group of people that electronically alters their voices in real-time, but not for listeners. These are individuals with speech disabilities, in particular stuttering. A device called delayed auditory feedback (DAF) has been used to treat stuttering for 30 years. The user speaks into a microphone and hears his voice in the headphones a fraction of a second later (in the range of 50–250 ms).

DAF reduces stuttering approximately 75–80%. It can also train a person to overcome stuttering, and no longer need to use a device. DAF is effective for two reasons:

A short delay (25–75 ms) overcomes the stapedius muscle reflex in the middle ear, which attenuates your perception of your voice by 5–15 dB. This is known as an audition, or hearing, function. Altering your voice to sound like someone else, paradoxically, makes you more aware of your voice. Improved vocal awareness improves vocal control, and the user is able to speak fluently. He reverts to stuttering when he removes the headphones.

A long delay (100–220 ms) forces the user to speak slower, stretch vowel sounds, join syllables, and speak at a constant vocal volume. This makes the user's vocal folds vibrate steadily (called continuous phonation) instead of abruptly starting and stopping (as characterizes stuttering). This is known as an motoric, or muscle control, function. Many hours of using this slow speech can retrain the muscle coordination of users, and they no longer stutter.

DAF is only effective with headphones. Several studies have investigated why hearing DAF through speakers does not effect stuttering. The reasons are as explained above: too many auditory signals confuse the speaker.

Another audition-type device that affects stuttering is frequency-altered auditory feedback (FAF). The user speaks into a microphone and hears his voice in headphones, altered in pitch. A half-octave shift in pitch (up or down) reduces stuttering as effectively as a short delay. As with a short delay, altering your voice to sound like someone else improves your awareness of you voice.

FAF does not produce carryover fluency, after the user removes the headphones, so it is not used in speech therapy.

Each of the above noted methods and systems may alter the mental state of a speaker and vocally convey a more favorable impression to listeners, and aid the performance of public speaking. However, developing a confident, relaxed mental state and voice when performing public speaking takes years of training and practice. Due to the limitations associated with each method and system, it has been determined that the need exists for a fast, simple method to alter the mental state of speakers and to vocally convey a favorable impression to listeners, especially in the performance of public speaking.

OBJECTS OF THE INVENTION

The general objects of the invention is to alter the mental state of the person who is speaking, and to convey this altered mental state to listeners via vocal inflections and cadence.

More specific objects of the invention include:

Improving the performance of public speaking.

Improving the performance of speaking on telephones.

Producing a mental state in the user of confidence, authority, and relaxation, and enabling the user to speak slowly and clearly.

Producing a mental state in the user of happiness and enthusiasm, and enabling the user to smile and talk faster.

Producing a mental state in the user of amusement.

Additional objects, advantages and novel features of the invention will be set forth in the description which follows, and in part will become apparent to those skilled in the art upon examination of the following or may be learned by practice of the invention. The objects and advantages of the invention may be realized and attained by means of the instrumentalities and combinations particularly pointed out in the claims.

DISCLOSURE OF THE INVENTION

According to the present invention, the user's mental state is altered by providing the user's voice to the user's ears, electronically altered to sound as if the user were in a different mental state, as the user speaks.

Several such mental states are specified in the invention.

The first mental state is confident, authoritative, and relaxed, with slow, clear speech. This is state is produced by Shifting the pitch of the user's voice down a quarter- or half-octave.

Delaying the user's voice to his ears approximately 100 milliseconds. This causes the user to talk slower.

Use of a "ring modulator". A ring modulator multiplies the signal with another signal (usually a sine wave with an adjustable frequency), resulting in a spectrum that has all sum- and difference frequencies of the original signal and the modulating sine. The effect is usually inharmonic, making the user's voice sound unemotional.

Several digital effects enhance the user's awareness of his or her voice, making the primary effects (the pitch shift and delay) more effective. These secondary effects are:

Reverb (echoes), which makes the room seem larger to the user.

Chorus, which makes the user's voice sound fuller, by adding a delayed, pitch-modulated version of the audio signal to the first audio signal.

The binaural effect, which switches the sound from one ear to the other ear, five to one hundred times per second. It makes the user's voice seem bigger.

These combined effects are powerfully effective in altering the speaker's mental state.

The second mental state is happy and enthusiastic, with faster speech and smiling. This state is produced by shifting the pitch of the user's voice up a quarter- or half-octave. The effectiveness is again enhanced with reverb, chorus, the binaural effect, and flanging.

Flanging makes the user's voice ring like a clear bell by adding feedback from a process similar to chorus, but with a shorter delay.

These two mental states are useful for aiding persons engaged in public speaking.

The invention is also useful for other speaking situations where people experience undesirable mental states. Some people, for example, experience anxiety when speaking on telephones.

A third mental state is amusement. The invention includes programs for a robot, alien, and ghost, similar to the "Voice Changer" toy, plus an astronaut. (The Voice Changer toy provides the user's altered voice through a loudspeaker to anyone nearby, to the annoyance of many parents. This invention provides the user's voice exclusively to the user.)

These effects use several other digital effects:

Equalization, which can attenuate or boost low, middle, high frequencies.

Distortion.

Dynamic range compression makes the voice sound flatter.

The "robot" voice is created with a ring modulator, a delay, and reverb.

The "alien" voice is created with flanging, an upward pitch shift, and the binaural effect set to a slow 200 milliseconds (which creates a sense of the voice zipping around like a UFO).

The "ghost" is produced with a midrange boost, a delay, and reverb.

The "astronaut", sounding like he is speaking over a long-distance radio, is produced with dynamic compression, distortion, a small downward pitch shift, and a short delay.

A feature of this invention is that no one but the speaker hears the electronically-altered voice. It is provided only to the user. The user typically using in-ear earphones, so that no one knows that the user is using the device.

To insure that the device does not pick up and garble other persons' voices, and environmental noise, the invention includes a voice-operated switch to switch the sound on only when the user speaks.

This invention results in a desirable chance in the user's mental state. The user develops the confidence to make a serious presentation to the board of directors, or develops the enthusiasm to tell jokes on-stage.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1:
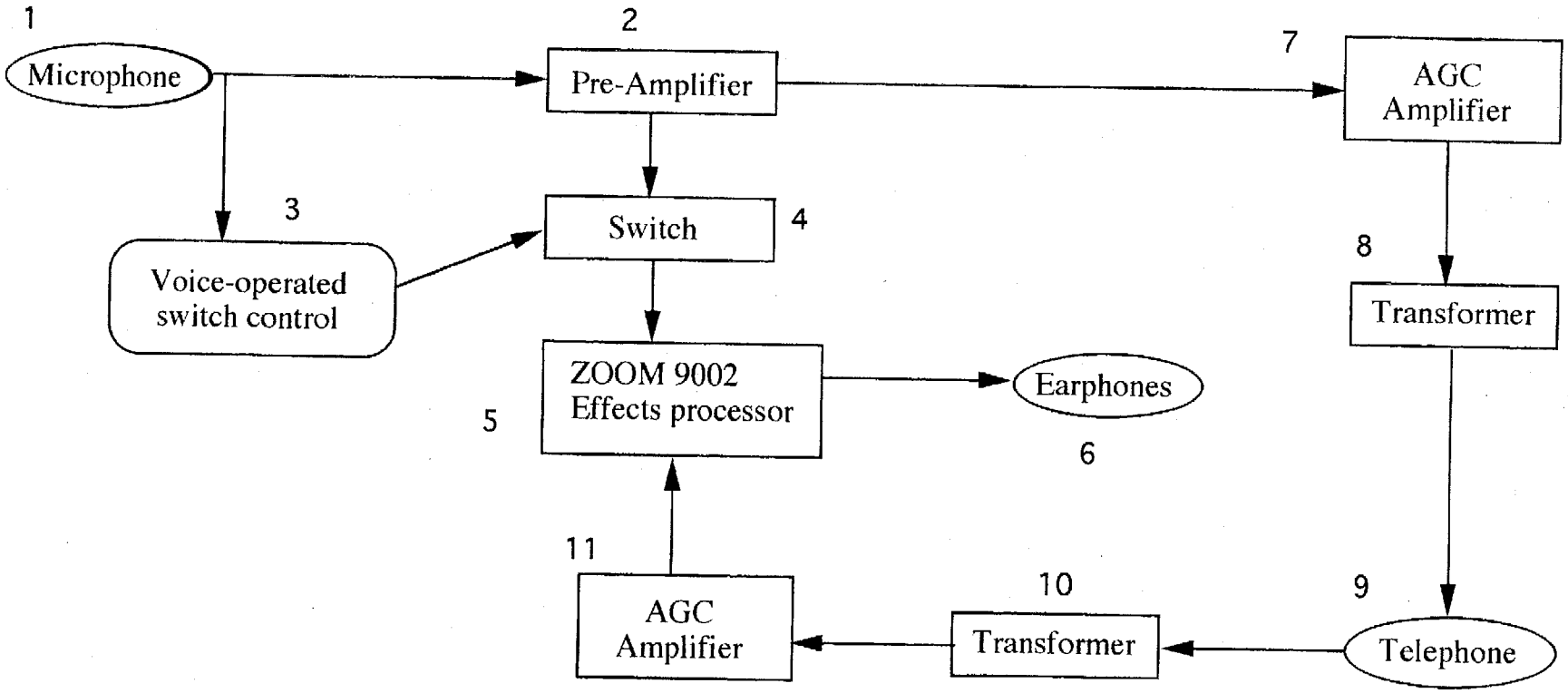
FIG. 1 is a block diagram of an embodiment of the invention.

Operation of invention. In this scenario, Isabella Felzer, manager of information systems at Quantrill Industries, has to make a presentation to the president and officers of the company. Ms. Felzer took a speech class years ago in college, but hasn't given many speeches since. She experiences anxiety when thinking about her upcoming presentation. She wants to appear and feel confident, authoritative, and relaxed.

Ms. Felzer also knows that there will be several executives from Fujitsu, Quantrill's partner in computer systems development. These executives are from Japan, and their comprehension of spoken English is not ideal. Ms. Felzer will prepare overhead charts so that they can read the key points of her presentation, but she also wants to speak slowly and clearly, to improve their comprehension.

Ms. Felzer doesn't have time to take another public speaking course or attend Toastmasters meetings, so she buys an electronic speaking aid for $199.

Minutes before the presentation, she puts a miniature combination microphone and in-ear earphone in one ear, and an in-ear earphone in her other ear.

Ms. Felzer switches the power on, pushes a button labeled "happy", and adjusts the volume. She mentally notes where the button labeled "Confidence" is. She puts the electronic speaking aid in her pocket.

At 10:00 am, Ms. Felzer introduces herself. Her voice in her ears sounds somewhat higher, subtly fuller, and resonating as if the room were concert hall. Her voice also has a ringing on certain sounds, like a clear bell.

She smiles at the high voice, and begins her presentation with a joke. She then enthusiastically welcomes the Japanese visitors.

She then pushes the button labeled "Confidence", and begins her presentation. She hears her voice shifted deeper. Her voice also seems slower. She speaks slowly, and clearly articulates each sound. Again she hears the concert hall resonance.

She feels confident, authoritative, and relaxed. She presents her plans for a new information system linking Quantrill's worldwide operations.

Halfway through her slides, she realizes that she only has fifteen minutes left to finish her presentation. She pushes the "Happy" button again, and doubles her speaking rate. Luckily, she'd presented the technical information in the first half of her talk, and in the second half describes the benefits of the new information system. She sounds enthusiastic about the new system, smiling, after every point.

She speeds through the remainder of her presentation, leaving time to answer questions.

Later, in the evening, Isabella calls her father-in-law to ask for a loan, to help pay for her son's college tuition. She sometimes feels intimidated by her father-in-law, and has never liked asking for personal loans. Isabella puts on a headset, with a boom microphone, that came with the electronic speaking aid. She plugs the electronic speaking aid into her telephone.

She makes the call, and hears her father-in-law loud and clear in the headphones. She hears her own voice loud and clear too, sounding confident. She talks about her son's good grades, and when she asks for the loan, her father-in-law insists on giving her the money, without repayment.

Description of invention. FIG. 1 shows a block diagram of an embodiment of the invention. The user speaks into a microphone (1). The audio signal is amplified (2), then goes through a voice-operated switch (3&4). The audio signal then goes to an effects processor (5) designed for electric guitars (Zoom 9002, made by Samson Technologies, of Hicksville, N.Y.). The effects processor changes the pitch of the signal, delays it, adds reverb, chorus, etc. The signal then goes to the user's earphones (6).

To connect to a telephone, the user's unaltered voice goes from the pre-amplifier (2) to an automatic gain control (AGC) amplifier (7), which insures that the voice transmitted to the telephone is never loud enough to damage telephone company equipment. The audio signal then goes through a transformer (8) and to the telephone (9).

The received voice from the telephone (9) goes through a transformer (10), then through another automatic gain control (AGC) amplifier (11), which insures that the voice received to the telephone is never loud enough to damage the user's ears. The audio signal then goes to the "mix" input of the effects processor, where it is sent altered to the user's headphones.

Figure 2A:
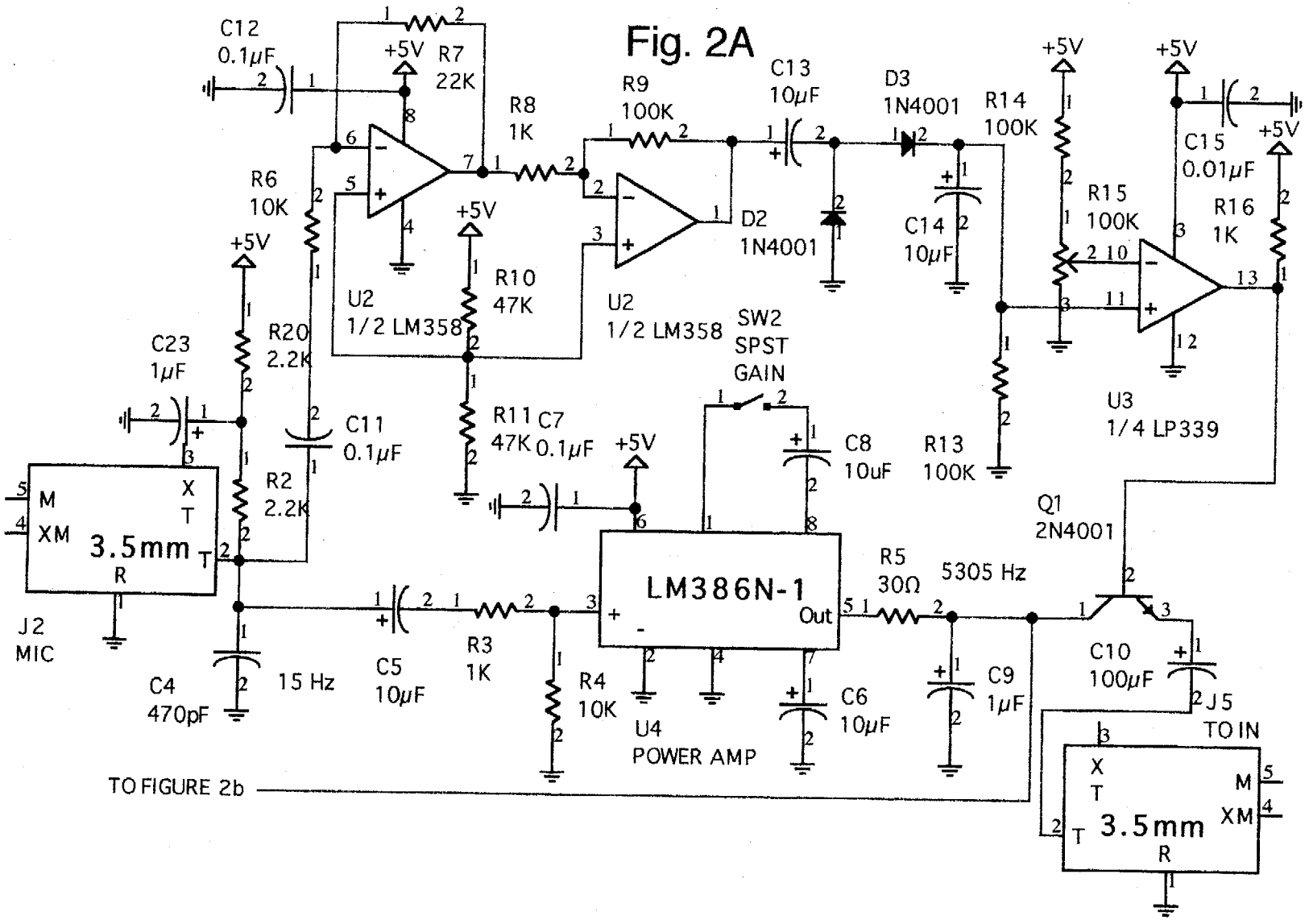
FIGS. 2*a*–2*b* show an electronic schematic diagram of an embodiment of the invention.
Figure 2B:
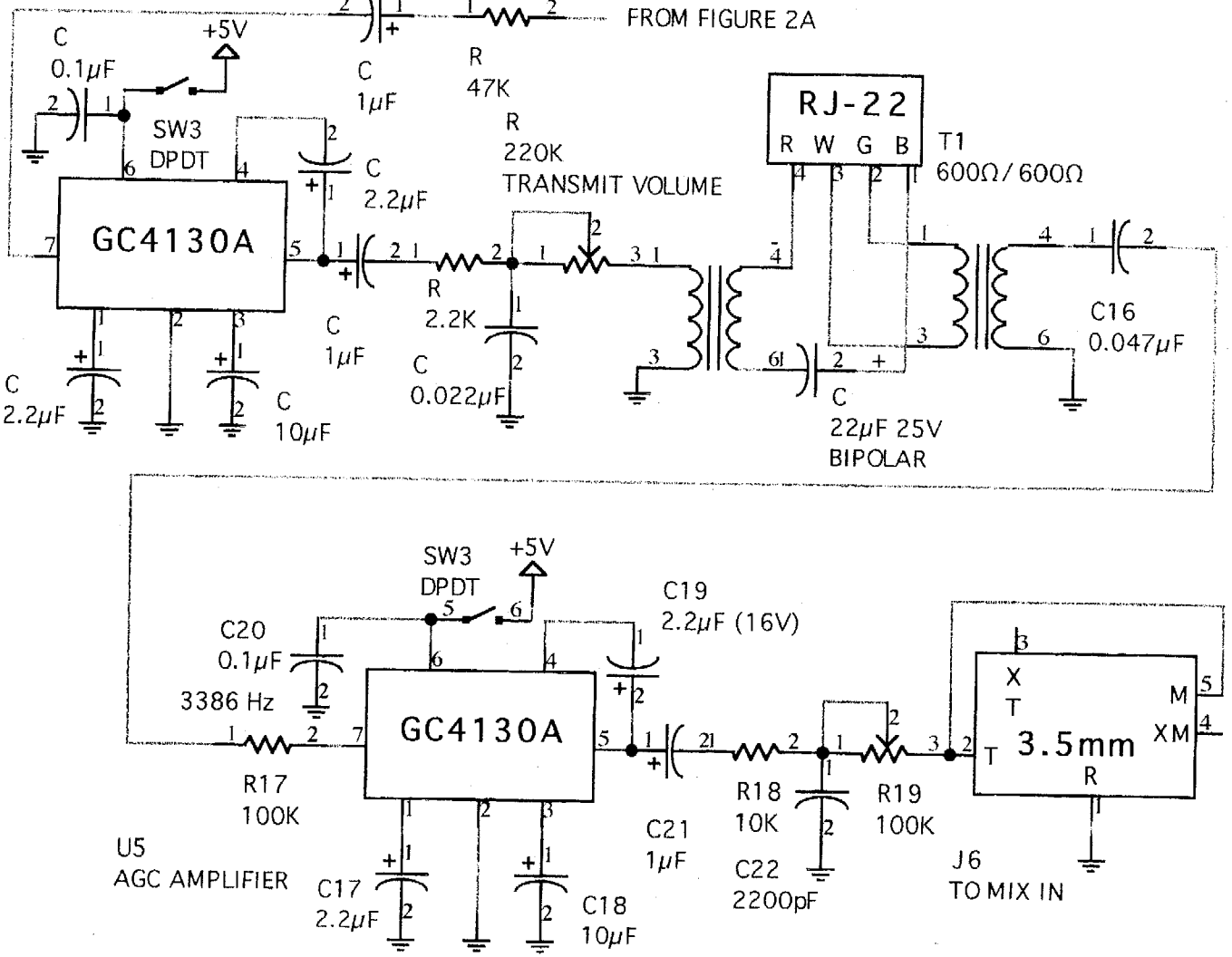
Figure 2C:
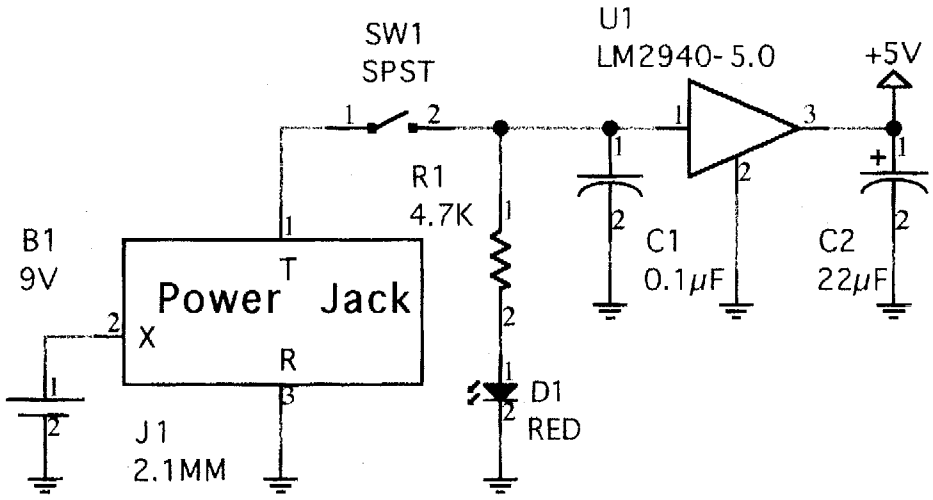
FIG. 2*c* is the power supply.

FIG. 2 shows an electronic schematic diagram of the embodiment of the invention shown in FIG. 1. The manufacturers of the integrated circuits provide databooks showing the external parts, such as resistors and capacitors, needed to operate each integrated circuit. The capacitors and resistors in FIG. 2 are provided in accordance with manufacturers' preferred configurations.

The microphone plugs in 3.5 mm jack J2. The microphone is biased by resistors R2, R20, and capacitor C23. Amplifier U4 (an LM386N-1, made by National Semiconductor of Santa Clara, Calif.) amplifies the signal 20 times, or 26 dB. This is the preferred configuration for use with a throat microphone or headset.

For use with an in-ear or lapel microphone, amplifier U4 must amplify the signal 200 times, or 46 dB, to compensate for the microphone being further from the user's mouth. This increased gain is accomplished by capacitor C8. Capacitor C8 is connected and disconnected by switch SW2.

Resistor R5 and capacitor C9 provided a 5305 Hz low-pass filter, removing noise produced by the amplifier.

The voice-operated switch (VOX) circuit switches off the audio signal when the user stops talking. This circuit uses a dual op-amp (an LM358, made by National Semiconductor, of Santa Clara, Calif.) to amplify the signal from the microphone (46 dB gain). The alternating current (AC) signal is then rectified by diodes D2 and D3 into direct current (DC). RC circuit C14 and R13 cause the VOX circuit to switch on and off slightly slower, letting users take a breath without the distraction of the audio signal switching off.

The DC voltage then enters comparator U5 (one-fourth of the LP339 comparator, made by National Semiconductor, of Santa Clara, Calif.). Resistor R14 and potentiometer R15 provide a reference voltage. When the user talks, the DC voltage is greater than the reference voltage, and the comparator outputs "high." When the user stops talking, the DC voltage drops below the reference voltage, and the comparator outputs low.

The output of comparator U5 goes to transistor Q1. This transistor acts as a switch, switching the audio signal on or off.

The user may adjust the VOX threshold (for quiet offices vs. loud parties) by adjusting potentiometer R15.

The signal then goes to the Zoom 9002 effects processor and later to headphones. The effects processor programming is described below. The effects processor is the size of a Walkman-style personal stereo, so easily fits in the user's pocket.

The telephone interface gets the audio signal from the amplifier, before the voice-operated switch and effects processor. The listener hears the caller's unaltered voice. The signal then is limited by automatic gain control (AGC) amplifier (a GC4130, made by Gennum, of Ontario, Canada), which limits the audio signal to a preset voltage level. The AGC output goes to a transformer and then to the telephone.

The received signal from the telephone goes through another transformer, then through another automatic gain control (AGC) amplifier (GC4130). This compensates for varying, levels caller's speech and poor connections. It also prevents sound from the telephone from exceeding 85 dB and damaging the user's ears, which is an OSHA requirement for telephone headsets.

The signal then goes to the Zoom 9002 effects processor, where it is mixed with the user's altered voice and provided to the headphones. The mix input does not alter the received voice, so you hear the other person sounding normal.

Switch SW3 switches off the telephone interface amplifiers when the user is not using a telephone. This saves battery power and slightly improves sound.

A voltage regulator (an LM2940-5.0, made by National Semiconductor, of Santa Clara, Calif.) maintains a steady 5-volt supply from either a 9-volt battery or a plug-in AC transformer.

Microphones. Plantronics, of Santa Cruz, Calif., makes a miniature combination in-ear earphone/microphone that is inconspicuous and easy to use (the H72). Because the microphone is about six inches from the user's mouth, the sound isn't as good as a full-sized headset with a boom microphone.

Koss Stereophones, of Milwaukee, Wis., makes a lightweight (3 ounce) headset with a boom microphone (SB/20). The headphones feature 20–20,000 Hz frequency response, superior in reproducing the full vocal range, as compared to telephone headsets with a 300–3000 Hz frequency range.

Many companies make lapel microphones. This are less convenient than the Plantronics in-ear microphone, and have worse sound than the Koss headset.

Another microphone choice is to tape a microphone to the user's neck, either in front of the larynx or below the ear. This is easily done using a miniature (6 mm diameter) microphone, such as the EM118, made by Primo, of Japan. The sound is loud and clear, with no background noise. However, your voice sounds somewhat odd, with laryngeal phonation (humming) louder, and nasal resonance attenuated. The result is a flatter-sounding voice. This microphone choice is somewhat inconvenient, and conspicuous.

Headphones. Any type of headphones or earphones may be used, as the user wishes.

Effects programming. The Zoom 9002 comes with 20 pre-set programs for guitar effects, which are of no use to persons speaking. The Zoom 9002 also has a memory bank for 20 user-set programs. In the present embodiment, the user will have to program this memory bank. Perhaps in the future, the Zoom 9002 effects processor could be manufactured with these 20 vocal effects pre-programmed instead of the 20 guitar effects. The user could also program his own effects, and store them in memory.

The 20 user-set programs are grouped in five banks (0–4) of four programs.

These 20 user-set programs are listed in Appendix 1.

The first bank is for enabling the user to feel confidant, authoritative, and relaxed, and to speak slowly and clearly. Four programs are provided, from subtle to powerful. Some users prefer a subtle effect, while others prefer a powerful effect. The four programs are ordered from most subtle to most effective:

Bank 0, Program 1: "Large Hall". Chorus, 50 ms delay, reverb. This subtly improves confidence, without altering pitch.

Bank 0, Program 2: "Semi-Deep Voice". Quarter-octave lower pitch, 50 ms delay, reverb. This is well-liked. The voice is only shifted a quarter-octave, producing a sense of confidence without the voice sounding like someone else. The reverb improves confidence and sense of space.

Bank 0, Program 3: "Deep Voice". Half-octave lower pitch, 50 ms delay. This is highly effective in enabling confidence, etc.

Bank 0, Program 4: "Slow Deep Voice". Half-octave lower pitch, 100 ms delay. This is the most powerful effect of enable confidence, etc. It forces the user to talk slowly.

The next bank (Bank 1) causes the user to feel happy and enthusiastic, talk faster, and smile. Again, these effects are ordered from subtle to effective.

Bank 1, Program 1: "Chorus". This provides a fuller voice, a subtle effect.

Bank 1, Program 2: "Semi-Happy". Quarter-octave higher pitch, reverb, binaural effect. This is the happy effect that most people prefer. It provides a reasonable boost in enthusiasm, without making the user giggle uncontrollably.

Bank 1, Program 3: "Happy". Half-octave higher pitch, binaural effect. This has a powerful effect.

Bank 1, Program 4: "Slow, But Happy". Half-octave higher pitch, 100 ms delay. This forces the user to talk slowly.

The next bank (Bank 2) is science-fiction effects. These are intended for amusement, not for public speaking.

Bank 2, Program 1: "Robot". Ring modulator, 50 ms delay, binaural effect. This effect can also be used for public speaking, if the user wishes to speak slowly and unemotionally.

Bank 2, Program 2: "Alien". Flanger (secondary harmonics), 200 ms binaural effect. This is the most amusing effect. The flanger adds a metallic ringing to the user's voice. The 200 ms binaural effect makes the voice seem to zip around.

Bank 2, Program 3: "Ghost". Midrange boost, 50 ms delay, reverb. This makes the user's voice sound "windy" and echoing, like something you'd hear on a dark and stormy night.

Bank 2, Program 1: "Astronaut". Distortion, quarter-octave lower pitch, 30 ms delay, binaural. This sounds just like NASA's poor-quality radio transmissions from space.

An alternative to the "Astronaut" is "R2D2", a random, stepped sample & hold program. The effects processor samples the pitch of the user's voice and provides a beep at that pitch. This sound like the robot in "Star Wars".

The next user bank (Bank 3) is for speech therapy. It has four delayed auditory feedback (DAF) settings (50, 100, 150, 200 ms).

The last bank (Bank 4) is for plugging a lapel microphone directly into the Zoom 9002 effects processor, without the 46-dB gain pre-amplifier and voice-operated switch described above. The distortion control on the Zoom 9002 increases gain, for reasons not clear to me. This set-up is acceptable for short speeches, where equipment of minimal size and visibility is needed.

Bank 4, Program 1: "Deep voice". Half-octave lower, 50 ms delay, distortion.

Bank 4, Program 1: "Happy voice". Half-octave higher, binaural effect, distortion.

Bank 4, Program 1: "100 ms delay". 100 ms delay, distortion. For persons who stutter.

Bank 4, Program 1: "Robot". Ring modulator, 50 ms delay, binaural effect, distortion.

The specific program instructions for the Zoom 9002 effects processor are listed on the following page.

Thus, by utilizing the above construction, an apparatus can be built to alter the mental state of a user while speaking.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative, and not in a limiting sense.

It will also be understood that the following claims are intended to cover all of the generic and specific features of the invention, herein described, and all statements of the scope of the invention which, as a matter of language, might be said to fall therebetween.

APPENDIX 1

Thomas David Kehoe

| User | Bank | Parameters |
|---|---|---|
| 0 | 1 | Large Hail<br>Delay1: Decay 0, Time 5, Balance 10.<br>Reverb1: Time 3, Balance 5.<br>Volume: 99. |
| 0 | 2 | Semi-Deep Voice<br>Pitch: −3, Fine 0, Balance 10.<br>Delay1: Decay 0, Time 5, Balance 10.<br>Reverb1: Time 3, Balance 5.<br>Volume: 99. |
| 0 | 3 | Deep Voice<br>Pitch: −6, Fine 0, Balance 10.<br>Delay1: Decay0, Time 5, Balance 10.<br>Volume: 99. |
| 0 | 4 | Slow Deep Voice<br>Pitch: −6, Fine 0, Balance 10.<br>Delay1: Decay 0, Time 10, Balance 10.<br>Volume: 99. |
| 1 | 1 | Chorus<br>Chorus: Depth 10; Freq 20; Pattern 2.<br>Volume: 99. |
| 1 | 2 | Semi-Happy<br>Pitch: Pitch 3, Fine 0, Balance 10.<br>Delay1: Decay 0, Time 1 , Balance 10.<br>Reverb1: Time 3, Balance 5.<br>Volume: 99. |
| 1 | 3 | Happy<br>Pitch: Pitch 6, Fine 0, Balance 10.<br>Delay2: Decay 0, Time 5, Balance 10.<br>Volume: 99. |
| 1 | 4 | Slow, But Happy<br>Pitch: Pitch 6, Fine 0, Balance 10.<br>Delay1: Decay 0, Time 10, Balance 10.<br>Volume: 99. |
| 2 | 1 | Robot<br>Delay1: Decay 5, Time 5, Balance 10.<br>Delay2: Decay 5, Time 5, Balance 10.<br>SFX: Depth 0, Freq 0, Pattern 3.<br>Volume: 99. |
| 2 | 2 | Alien<br>Flanger: Depth 10; Freq 20; Peak 10.<br>Delay2: Decay 0, Time 20, Balance 10.<br>Volume: 99. |
| 2 | 3 | Ghost<br>Phaser: Depth 10, Freq 0, Pattern 2.<br>Delay1: Decay 0, Time 5, Balance 10.<br>Reverb1: Time 7, Balance 10.<br>Volume: 99 |

APPENDIX 1-continued

Thomas David Kehoe

| User | Bank | Parameters |
|---|---|---|
| 2 | 4 | Astronaut<br>Distortion: 6.<br>Pitch: Pitch −3, Fine 0, Balance 10.<br>Delay1: Decay 0, Time 3, Balance 10.<br>Delay2: Decay 0, Time 3, Balance 10.<br>Volume: 35. |
| 2 | 4 | R2D2<br>SFX: Pattern 1, Depth 10, Freq 50.<br>Volume: 99. |
| 3 | 1 | 50 ms DAF<br>Delay1: Decay 0, Time 5, Balance 10.<br>Volume: 99. |
| 3 | 2 | 100 ms DAF<br>Delay1: Decay 0, Time 10, Balance 10.<br>Volume: 99. |
| 3 | 3 | 150 ms DAF<br>Delay1: Decay 0, Time 15, Balance 10.<br>Volume: 99. |
| 3 | 4 | 200 ms DAF<br>Delay1: Decay 0, Time 20, Balance 10.<br>Volume: 99. |
| 4 | 1 | Lapel Microphone - Deep Voice<br>Distortion: Depth 12.<br>Pitch: Pitch −6, Fine 0, Balance 10.<br>Delay1: Decay 0, Time 5, Balance 10.<br>Volume: 99. |
| 4 | 2 | Lapel Microphone - Happy Voice<br>Distortion: Depth 12.<br>Pitch: Pitch +6, Fine 0, Balance 10.<br>Delay2: Decay 0, Time 5, Balance 10.<br>Volume: 99. |
| 4 | 3 | Lapel Microphone - 100 ms delay<br>Distortion: Depth 12.<br>Delay1: Decay 0, Time 10, Balance 10.<br>Volume: 99. |
| 4 | 4 | Lapel Microphone - Robot<br>Distortion: Depth 12.<br>Delay1: Decay 0, Time 5, Balance 10.<br>Delay2: Decay 0, Time 5, Balance 10.<br>SFX: Depth 0, Freq 0, Pattern 3.<br>Volume: 99 |

What is claimed is:

1. A method to alter the emotional state of a person who is speaking, comprising the steps of:

storing information in a predefined array, each array element containing data representing an emotional state identifiable to the speaker and at least one modifiable audio characteristic, each of said emotional states being uniquely addressable through an entry in said predefined array;

selecting a desired entry from said predefined array representing a speaker's desired emotional state;

detecting the speaker's voice with a transducer;

converting the output of said transducer to a first output signal;

altering said first output signal in accordance with said modifiable audio characteristic from said predefined array;

converting said altered signal to an audio signal perceptible by said speaker; and providing said perceptible audio signal to a plurality of the speaker's ears, whereby the speaker's desired emotional state is altered by the process of hearing his or her own altered voice.

2. The method to alter the emotional state of a person who is speaking, as claimed in claim 1, wherein said altered audio signal is provided to a plurality of the speaker's ears within one second of the speaker speaking.

3. The method to alter the emotional state of a person who is speaking, as claimed in claim 1, wherein the step of providing said audio signal to the speaker's ear includes the step of preventing said audio signal from being heard by any person other than the speaker.

4. The method to alter the emotional state of a person who is speaking, as claimed in claim 1, wherein the step of altering said first output signal comprises the step of modifying the frequency of said audio signal in accordance with a predefined multiplier prior to passing the audio signal to the speaker's ear.

5. The method of claim 4, wherein the predefined frequency multiplier is a number less than one, producing an altered audio signal lower in pitch.

6. The method of claim 4, wherein the predefined frequency multiplier is a number greater than one, producing an altered audio signal higher in pitch.

7. The method to alter the emotional state of a person who is speaking, as claimed in claim 1, wherein the step of altering said first output signal comprises the step of delaying said audio signal for a predetermined period of time prior to passing the audio signal to the speaker's ear.

8. The method to alter the emotional state of a person who is speaking, as claimed in claim 7, wherein the step of delaying said audio signal further comprises the step of repeating and diminishing said delayed audio signal in an echo pattern.

9. The method to alter the emotional state of a person who is speaking, as claimed in claim 7, wherein the step of delaying said audio signal further comprises the step of modulating the pitch of the delayed signal according to a predetermined pattern, to produce a fuller-sounding chorus-like altered audio signal.

10. The method to alter the emotional state of a person who is speaking, as claimed in claim 9, wherein the step of delaying and modulating the pitch of said audio signal further comprises the step of feeding back and combining the delayed and modulated audio signal with the first audio signal, producing a ringing overtone in the altered audio signal.

11. The method to alter the emotional state of a person who is speaking, as claimed in claim 1, wherein the step of coupling said audio signal to the speaker's ears further comprises the step of providing said audio signal alternately to each ear of the speaker for a predetermined period of time.

12. The method to alter the emotional state of a person who is speaking, as claimed in claim 1, wherein the step of altering said first output signal comprises the step of producing the sum and difference of the first audio signal and a predetermined second audio signal, prior to passing the audio signal to the speaker's ear, producing a robotic-sounding altered audio signal.

* * * * *